US011084684B2

(12) United States Patent
Chang

(10) Patent No.: US 11,084,684 B2
(45) Date of Patent: Aug. 10, 2021

(54) RESTRICTION DEVICE FOR PREVENTING DEFORMATION OF RESTRICTION PLATE OF REEL

(71) Applicant: CHIPBOND TECHNOLOGY CORPORATION, Hsinchu (TW)

(72) Inventor: Chung-Yi Chang, Kaohsiung (TW)

(73) Assignee: CHIPBOND TECHNOLOGY CORPORATION, Hsinchu (TW)

( * ) Notice: Subject to any disclaimer, the term of this patent is extended or adjusted under 35 U.S.C. 154(b) by 199 days.

(21) Appl. No.: 16/354,282

(22) Filed: Mar. 15, 2019

(65) Prior Publication Data

US 2020/0231406 A1 Jul. 23, 2020

(30) Foreign Application Priority Data

Jan. 21, 2019 (TW) ..... 108102266

(51) Int. Cl.
*B65H 75/18* (2006.01)

(52) U.S. Cl.
CPC ..... *B65H 75/187* (2013.01); *B65H 2701/37* (2013.01)

(58) Field of Classification Search
CPC ... B65H 75/187; B65H 2701/37; B65H 49/32
See application file for complete search history.

(56) References Cited

U.S. PATENT DOCUMENTS 112,656 A * 3/1871 Vincent ..... B65H 75/06 242/537
2,214,315 A * 9/1940 Adamson ..... B65H 59/04 242/421.8

(Continued)

FOREIGN PATENT DOCUMENTS

CN 101021405 A 8/2007
CN 204643385 U 9/2015

(Continued)

OTHER PUBLICATIONS

Taiwanese Office Action dated May 16, 2019 for Taiwanese Patent Application No. 108102266, 3 pages.

(Continued)

*Primary Examiner* — Michael E Gallion
(74) *Attorney, Agent, or Firm* — Demian K. Jackson; Jackson IPG PLLC

(57) ABSTRACT

A restriction device for preventing deformation of restriction plate of reel is disclosed. The restriction device includes a first circular restrictor, a second circular restrictor, a block member and a first push member. A clamping space exists between the first and second circular restrictors mounted on a shaft and is configured to accommodate a reel mounted on the shaft. The second circular restrictor is able to be moved on the shaft in an axial direction, the block member is fixed on the shaft and the first push member is placed between the block member and the second circular restrictor. The first push member is configured to apply a force to push the second circular restrictor toward the first circular restrictor to press a first restriction plate of the reel such that the deformation of the first restriction plate is prevented.

13 Claims, 6 Drawing Sheets

(56) References Cited

U.S. PATENT DOCUMENTS 2,361,258 A * 10/1944 Bromm ..... B21C 47/28 242/575.3
2,803,413 A * 8/1957 Lyon ..... B65H 75/406 242/395
3,140,839 A * 7/1964 Whitecar ..... B65H 54/58 242/471
3,295,787 A * 1/1967 Golonka ..... A01K 89/003 242/129.8
3,979,833 A * 9/1976 Grundman ..... G01B 3/1084 33/701
4,190,211 A * 2/1980 Janzen ..... B65H 49/32 242/423.1
4,325,522 A * 4/1982 Sauber ..... B65H 49/32 188/72.9
4,717,086 A 1/1988 Crow
4,762,286 A * 8/1988 Crow ..... A01K 89/003 242/486.9
4,807,826 A * 2/1989 Iwahashi ..... G11B 23/037 242/608
4,842,215 A * 6/1989 Takami ..... B65B 13/18 242/129.3
4,948,059 A * 8/1990 Lewitt ..... A01K 89/003 242/129.6
2001/0014275 A1* 8/2001 Focke ..... B65H 75/10 414/680
2010/0147991 A1* 6/2010 Huang ..... B65H 75/22 242/609.1
2011/0095124 A1* 4/2011 Andrea ..... B65H 49/32 242/474.8

FOREIGN PATENT DOCUMENTS

| | | | |
|---|---|---|---|
| CN | 206915510 | U | 1/2018 |
| CN | 207903586 | U | 9/2018 |
| EP | 0147711 | A2 | 7/1985 |
| EP | 0813200 | A2 | 12/1997 |
| JP | S59-78350 | U | 5/1984 |
| TW | 201309582 | A1 | 3/2013 |
| TW | 201341293 | A | 10/2013 |
| WO | 2006/057043 | A1 | 6/2006 |

OTHER PUBLICATIONS

Chinese Office Action dated Apr. 13, 2021 for Chinese Patent Application No. 201910105742.3, 7 pages.

* cited by examiner

RESTRICTION DEVICE FOR PREVENTING DEFORMATION OF RESTRICTION PLATE OF REEL

FIELD OF THE INVENTION

This invention relates to a restriction device, and more particularly to a restriction device for preventing deformation of restriction plate of a reel.

BACKGROUND OF THE INVENTION

Flexible tapes or substrates are usually loaded on a reel made of plastic during manufacture thereof. However, two restriction plates on the reel may be deformed outwardly due to material variation, heat or external force.

The tapes or substrates may be reverse loaded on the reel continuously if the restriction plates of the reel are deformed outwardly. As a result, the tapes or substrates or the integrated circuit on the tapes or substrates may be damaged.

Otherwise, the distance between the edge of the tapes or substrates and the restriction plates of the reel may be less than a minimum allowable value or larger than a maximum allowable value if the tapes or substrates are loaded on the reel with deformed restriction plates, such that the tapes or substrates are obliquely loaded on the reel.

SUMMARY

The object of the present invention is to restrict a reel of a flexible tape or substrate by using a restriction device so that outward deformation of restriction plate of the reel is prevented.

A restriction device of the present invention is mounted on a shaft to clamp a reel. The restriction device includes a first circular restrictor, a second circular restrictor, a block member and a first push member. The first circular restrictor is mounted on the shaft. The second circular restrictor includes a first mount hole and is slidably mounted on the shaft in an axial direction through the first mount hole. A clamping space exists between the first and second circulator restrictors and is configured to accommodate the reel mounted on the shaft. The block member is fixed on the shaft, and the second circular restrictor is located between the first circular restrictor and the block member. The first push member is placed between the block member and the second circular restrictor and configured to apply a force to push the second circulator restrictor toward the first circular restrictor to press a first restriction plate of the reel.

Through the block member fixed on the shaft and the first push member located between the block member and the second circular restrictor, the second circular restrictor is pushed to press the first restriction plate of the reel so as to prevent the first restriction plate of the reel from deforming outwardly.

DETAILED DESCRIPTION OF THE INVENTION

Figure 1:
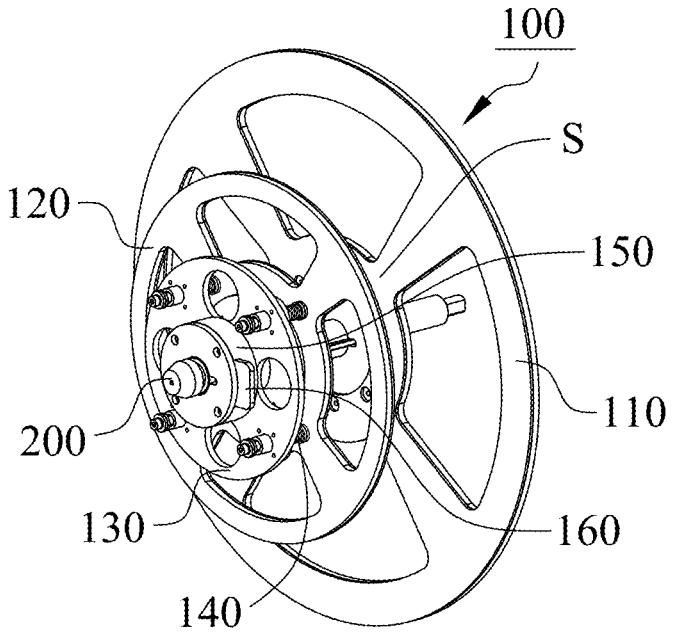
FIG. 1 is a perspective assembly diagram illustrating a restriction device in accordance with a first embodiment of the present invention.
Figure 2:
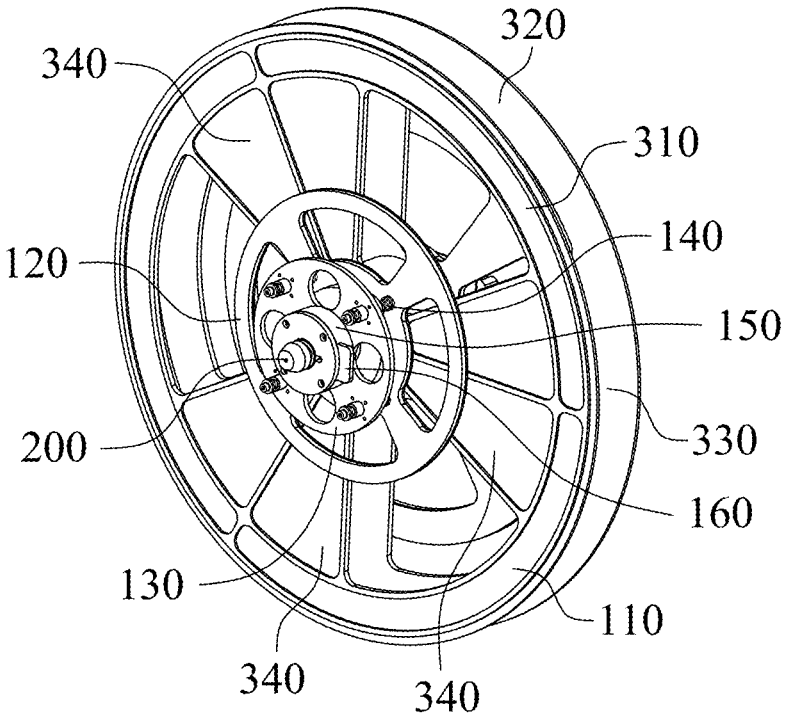
FIG. 2 is a perspective assembly diagram illustrating the restriction device clamping a reel in accordance with the first embodiment of the present invention.
Figure 3:
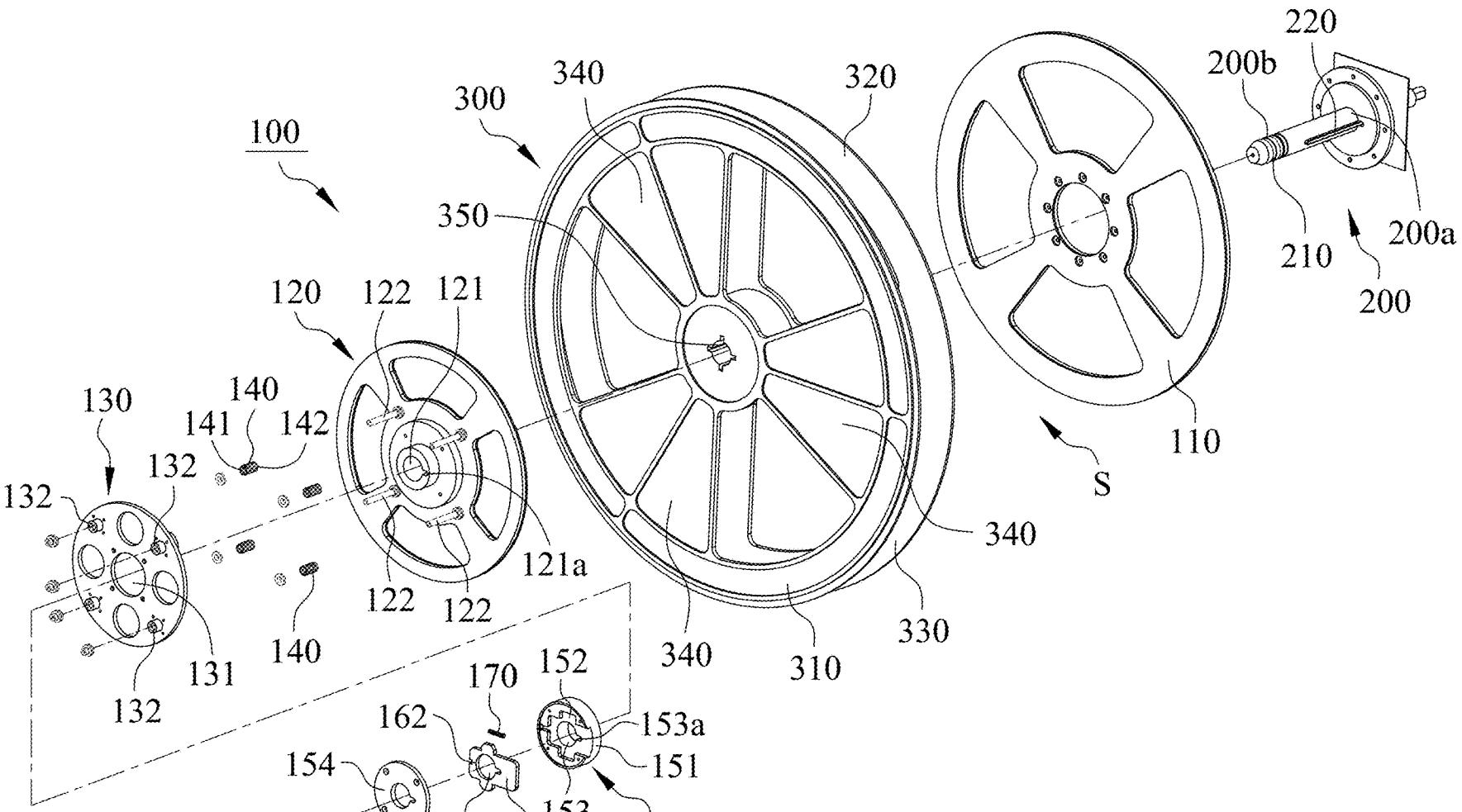
FIG. 3 is a perspective exploded diagram illustrating the restriction device in accordance with the first embodiment of the present invention.
Figure 4:
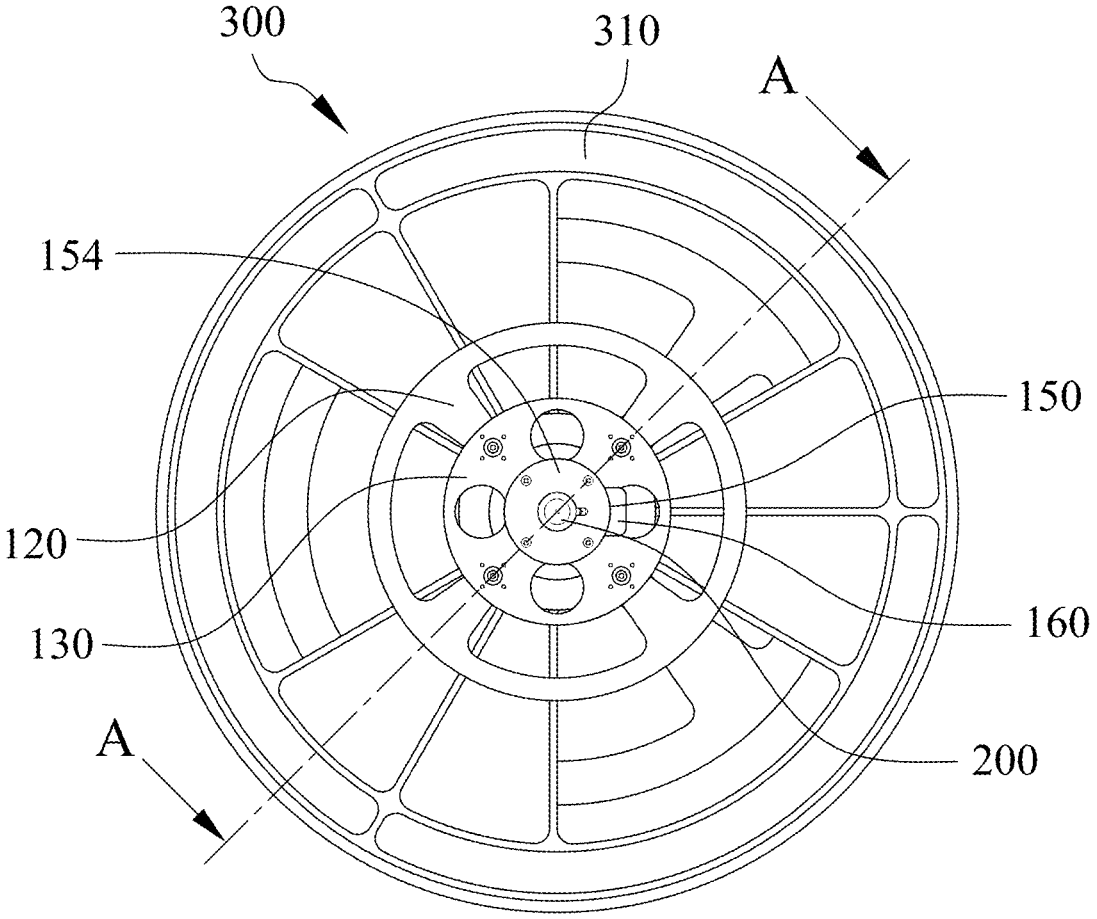
FIG. 4 is a side view diagram illustrating the restriction device in accordance with the first embodiment of the present invention.
Figure 5:
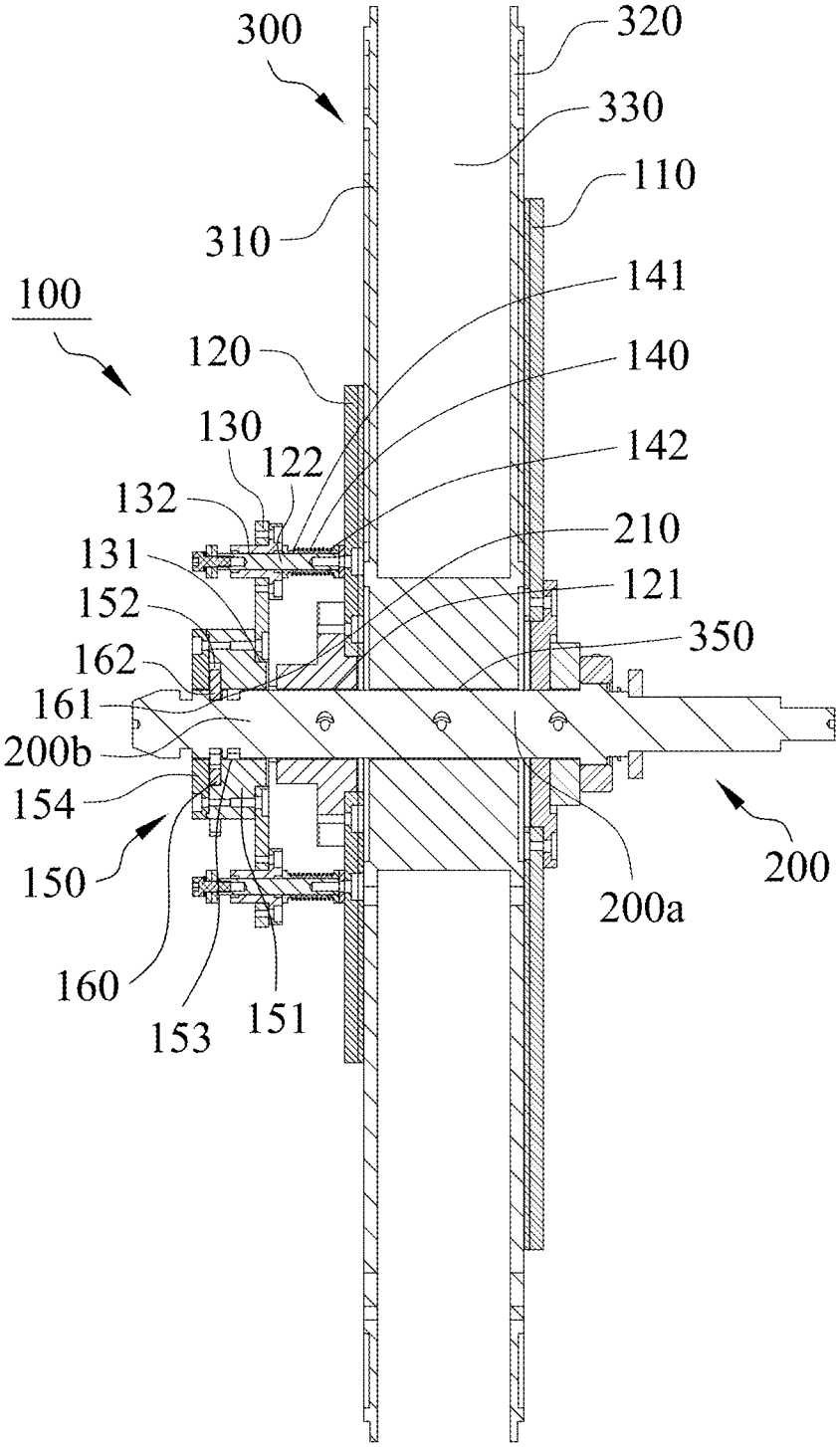
FIG. 5 is a cross-section view diagram of FIG. 4 taken along line A-A.

With reference to FIGS. 1, 2, 3 and 4, a restriction device 100 in accordance with a first embodiment of the present invention is mounted on a shaft 200 in order to clamp a reel 300. The reel 300 includes a first restriction plate 310, a second restriction plate 320 and a roll loading space 330, and a flexible tape or substrate (not shown) can be loaded into the roll loading space 330. Referring to FIGS. 3 and 5, the shaft 200 of the first embodiment has a fixed end 200*a* and a free end 200*b* and is connected to a base or table (not shown) from its fixed end 200*a*. The shaft 200 may be driven to rotate by power means, such as human or motor (not shown).

With reference to FIGS. 1, 3, 4 and 5, the restriction device 100 includes a first circular restrictor 110, a second circular restrictor 120, a block member 130 and at least one first push member 140. The first circular restrictor 110 is mounted on the shaft 200, and in the first embodiment, the first circular restrictor 110 is mounted on the fixed end 200*a* of the shaft 200. The second restriction plate 320 of the reel 300 rests on the first circular restrictor 110.

With reference to FIGS. 1, 3, 4 and 5, the second circular restrictor 120 is slidably mounted on the shaft 200 in an axial direction through a first mount hole 121. The second circular restrictor 120 in the first embodiment is mounted on the free end 200*b* of the shaft 200. A clamping space S exists between the first circular restrictor 110 and the second circular restrictor 120 and is configured to accommodate the reel 300 mounted on the shaft 200. In the first embodiment, there is a first notch 121*a* formed on a wall of the first mount hole 121, and there is a bulge 220 formed on the shaft 200. The bulge 220 is inserted into the first notch 121*a* such that the second circular restrictor 120 can be driven to rotate together with the shaft 200 in rotation.

With reference to FIGS. 1, 3, 4 and 5, the block member 130 is fixed on the free end 200*b* of the shaft 200, and in the first embodiment, the block member 130 is mounted on the shaft 200 through a second mount hole 131. The second circular restrictor 120 is located between the first circular restrictor 110 and the block member 130. The restriction device 100 preferably further includes a lock member 150. The lock member 150 is mounted on the free end 200*b* of the shaft 200, and the block member 130 is located between the second circular restrictor 120 and the lock member 150. The lock member 150 is configured to lock and fix the block member 130 on the free end 200*b* of the shaft 200.

With reference to FIGS. 2, 3, 4 and 5, the first push member 140 is placed between the block member 130 and the second circular restrictor 120. Because of the block member 130 fixed on the shaft 200, the first push member 140 is able to apply a force to push the second circular restrictor 120 toward the first circular restrictor 110 to press the first restriction plate 310 of the reel 300. In the first embodiment, the second circular restrictor 120 is configured to press a plurality of supporting ribs 340 of the first restriction plate 310.

With reference to FIGS. 3, 4, 5 and 6, the second circular restrictor 120 includes at least one guide rod 122 located between the block member 130 and the second circular restrictor 120. The first push member 140, may be a compression spring, is slidably mounted on the guide rod 122. A first end 141 and a second end 142 of the first push member 140 contact the block member 130 and the second circular restrictor 120, respectively, so as to push the second circular restrictor 120 toward the first circular restrictor 110.

With reference to FIGS. 3, 4, 5 and 6, the block member 130 preferably includes at least one guide hole 132, and the guide rod 122 is slidably inserted into the guide hole 132. While the second circular restrictor 120 is moved toward the block member 130 or the first circular restrictor 110, the guide rod 122 is moved in the guide hole 132 and together with the second circular restrictor 120. And the block member 130 is rotated together with the second circular restrictor 120 when the second circular restrictor 120 is in rotation.

With reference to FIGS. 3, 4, 5 and 6, the lock member 150 includes a body 151, an accommodation groove 152 and a third mount hole 153. The accommodation groove 152 is recessed on the body 151, the third mount hole 153 penetrates through the body 151 and communicates with the accommodation groove 152. The shaft 200 is inserted into the third mount hole 153 of the lock member 150. In the first embodiment, there is a second notch 153*a* formed on a wall of the third mount hole 153 and the bulge 220 is inserted into the second notch 153*a* such that the lock member 150 can be driven to rotate together with the rotated shaft 200.

Figure 6:
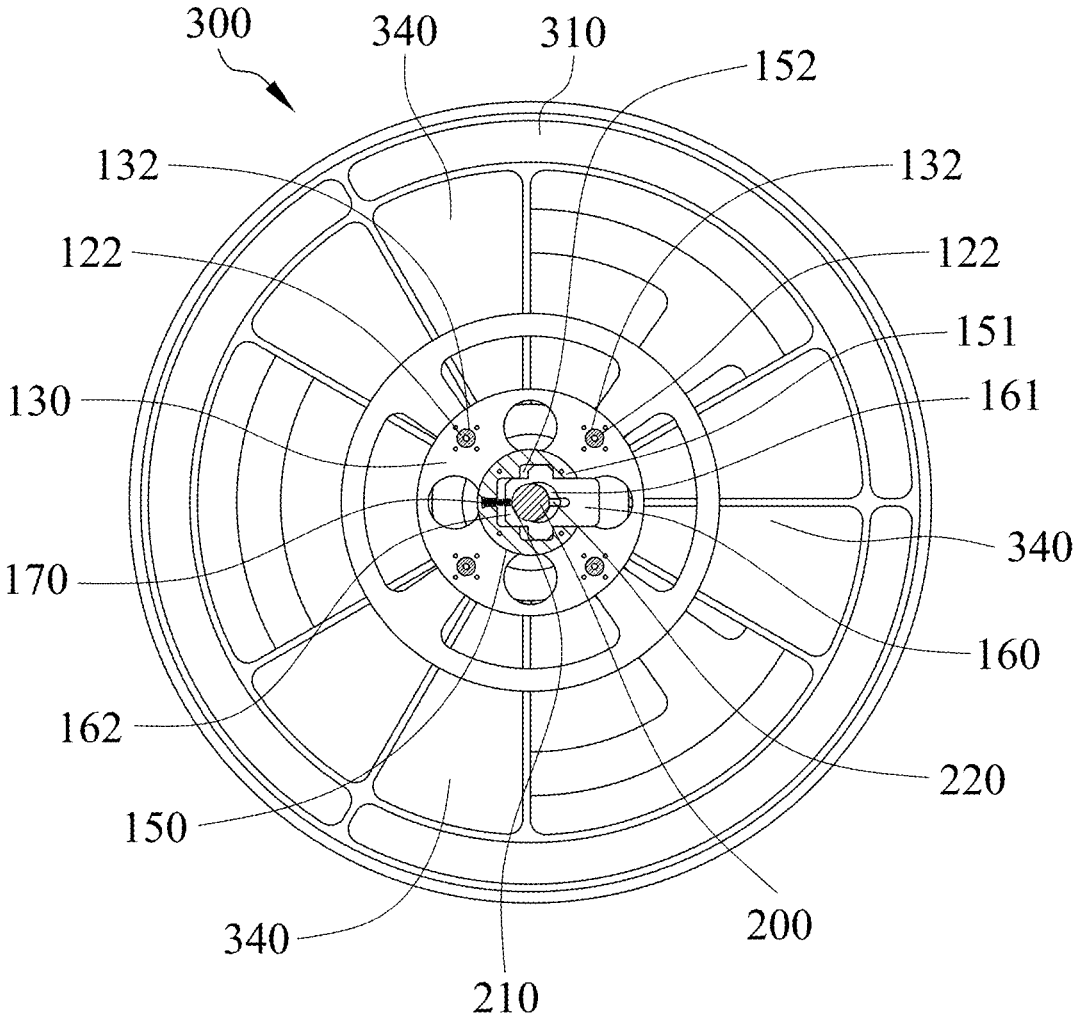
FIG. 6 is a cross-section view diagram illustrating the restriction device in accordance with the first embodiment of the present invention.

With reference to FIGS. 3, 4, 5 and 6, the restriction device 100 further includes a wedge 160 placed in the accommodation groove 152 movably. The wedge 160 includes a through hole 161 and a wedging portion 162 which is an edge of the through hole 161. The shaft 200 is slidably inserted into the through hole 161 of the wedge 160, and the wedging portion 162 of the wedge 160 is clamped in a positioning groove 210 on the shaft 200 so as to fix the lock member 150 on the shaft 200. The restriction device 100 preferably further includes a second push member 170 that may be a compression spring placed in the accommodation groove 152. Referring to FIGS. 3, 5 and 6, the second push member 170 is configured to push the wedge 160 to allow the wedging portion 162 to be clamped into the positioning groove 210 of the shaft 200. The lock member 150 further includes a lid 154 which is used to cover the accommodation groove 152 and connected to the body 151 such that the wedge 160 and the second push member 170 are held in the accommodation groove 152 and cannot depart from the lock member 150.

With reference to FIGS. 2, 3 and 5, the first circular restrictor 110, the reel 300, the second circular restrictor 120, the block member 130 and the lock member 150 are mounted on the shaft 200 in sequence. The wedge 160 placed on the lock member 150 is clamped in different positioning groove 210 on the shaft 200 according to the width of the reel 300 to fix the block member 130 on the shaft 200, and the second circular restrictor 120 is pushed by the first push member 140 toward to the first circular restrictor 110 to clamp the reel 300 between the first circular restrictor 110 and the second circular restrictor 120. The bulge 220 of the shaft 200 is inserted into a drive hole 350 of the reel 300, the first notch 121*a* of the second circular restrictor 120 and the second notch 153*a* of the lock member 150, thus the reel 300, the second circular restrictor 120, the block member 130 and the lock member 150 are driven to rotate together with the shaft 200 when the shaft 200 is rotated. And an outward deformation of the first restriction plate 310 of the reel 300 is prevented owing to the first push member 140 pushes the second circular restrictor 120 to press the first restriction plate 310, and furthermore to prevent the reel 300 from shifting.

Figure 7:
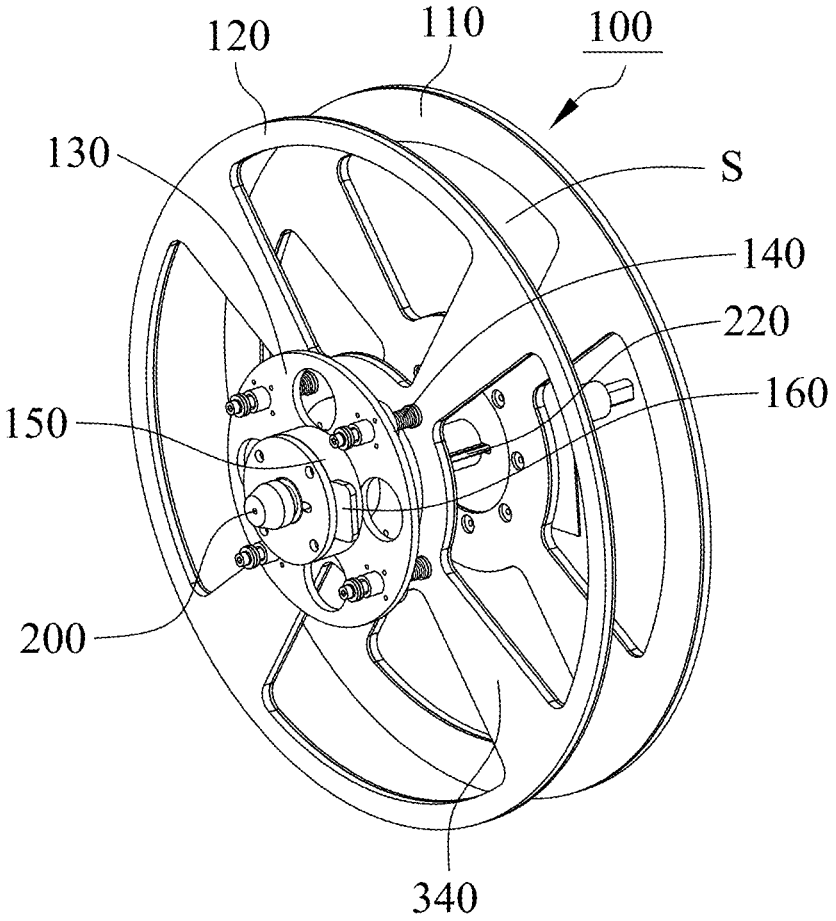
FIG. 7 is a perspective assembly diagram illustrating a restriction device in accordance with a second embodiment of the present invention.

FIG. 7 shows a restriction device 100 of a second embodiment. Different to the first embodiment, the second circular restrictor 120 has an outer diameter substantially equal to an outer diameter of the first circular restrictor 110 in the second embodiment.

While this invention has been particularly illustrated and described in detail with respect to the preferred embodiments thereof, it will be clearly understood by those skilled in the art that is not limited to the specific features shown and described and various modified and changed in form and details may be made without departing from the spirit and scope of this invention.

What is claimed is:

1. A restriction device which is mounted on a shaft to clamp a reel, the restriction device comprising:

a first circular restrictor mounted on the shaft;

a second circular restrictor including a first mount hole, the second circular restrictor is mounted on the shaft slidably in an axial direction through the first mount hole, a clamping space exists between the first and second circular restrictors and is configured to accommodate the reel mounted on the shaft;

a block member fixed on the shaft, the second circular restrictor is located between the first circular restrictor and the block member; and a first push member placed between the block member and the second circular restrictor, the first push member is configured to apply a force to push the second circular restrictor toward the first circular restrictor to press a first restriction plate of the reel.

2. The restriction device in accordance with claim 1 further comprising a lock member mounted on the shaft, wherein the block member is located between the second circular restrictor and the lock member, and the lock member is configured to fix the block member on the shaft.

3. The restriction device in accordance with claim 1, wherein there is a guide rod between the block member and the second circular restrictor, the first push member is slidably mounted on the guide rod, a first end and a second end of the first push member contact the block member and the second circular restrictor, respectively.

4. The restriction device in accordance with claim 3, wherein the block member includes a second mount hole and a guide hole, the block member is mounted on the shaft through the second mount hole, the guide rod is inserted into the guide hole and configured to be moved in the guide hole together with the second circular restrictor while the second circular restrictor is moved toward the block member or the first circular restrictor.

5. The restriction device in accordance with claim 4, wherein the block member is rotated together with the second circular restrictor.

6. The restriction device in accordance with claim 2 further comprising a wedge, wherein the wedge includes a through hole and a wedging portion which is an edge of the through hole, the lock member includes a body, an accommodation groove and a third mount hole, the accommodation groove is recessed on the body, the third mount hole penetrates through the body and communicates with the accommodation groove, the lock member is mounted on the shaft through the third mount hole, the wedge is placed in the accommodation groove movably and mounted on the shaft slidably through the through hole, the wedging portion of the wedge is configured to be clamped in a positioning groove on the shaft to fix the lock member on the shaft.

7. The restriction device in accordance with claim 6 further comprising a second push member placed in the accommodation groove, wherein the second push member is configured to push the wedge to allow the wedging portion to be clamped in the positioning groove of the shaft.

8. The restriction device in accordance with claim 7, wherein the lock member further includes a lid connected to the body, the lid is configured to cover the accommodation groove to restrict the wedge in the accommodation groove.

9. The restriction device in accordance with claim 1, wherein there is a first notch formed on a wall of the first mount hole and a bulge formed on the shaft, the bulge is inserted into the first notch such that the second circular restrictor is driven to rotate together with the shaft when the shaft is rotated.

10. The restriction device in accordance with claim 6, wherein there is a second notch formed on a wall of the third mount hole and a bulge formed on the shaft, the bulge is inserted into the second notch such that the lock member is driven to rotate together with the shaft when the shaft is rotated.

11. The restriction device in accordance with claim 9, wherein there is a second notch formed on a wall of the third mount hole and a bulge formed on the shaft, the bulge is inserted into the second notch such that the lock member is driven to rotate together with the shaft when the shaft is rotated.

12. The restriction device in accordance with claim 1, wherein the first circular restrictor is mounted on a fixed end of the shaft, the second circular restrictor and the block member are mounted on a free end of the shaft.

13. The restriction device in accordance with claim 1, wherein the second circular restrictor is configured to press a plurality of supporting ribs of the first restriction plate of the reel.

* * * * *